US005366275A

United States Patent [19]

Sulzer

[11] Patent Number: 5,366,275

[45] Date of Patent: Nov. 22, 1994

[54] GAS OPERATED FOOT STOOL

[75] Inventor: James H. Sulzer, Cedarburg, Wis.

[73] Assignee: L & P Property Management Company, Chicago, Ill.

[21] Appl. No.: 78,431

[22] Filed: Jun. 16, 1993

[51] Int. Cl.[5] ..... A47C 1/02

[52] U.S. Cl. ..... 297/347.19; 248/161

[58] Field of Search ..... 297/344.12, 344.18, 297/344.19; 248/161, 404

[56] References Cited

U.S. PATENT DOCUMENTS

| | | | |
|---|---|---|---|
| 3,029,106 | 4/1962 | McGuire | 297/217 |
| 3,143,332 | 8/1964 | Watlington | 248/404 |
| 3,147,946 | 9/1964 | Hale | 248/404 |
| 3,179,369 | 4/1965 | Hale | 248/404 |
| 3,278,229 | 10/1966 | Bates | 297/345 |
| 3,339,873 | 9/1967 | Hale | 248/404 |
| 3,376,068 | 4/1968 | Walkinshaw | 297/437 |
| 3,381,926 | 5/1968 | Fritz et al. | 248/404 |
| 3,458,234 | 7/1969 | Bates | 297/437 |
| 3,466,411 | 9/1969 | Martin | 200/86.5 |
| 3,711,054 | 1/1973 | Bauer | 248/400 |
| 3,891,270 | 6/1975 | Crossman et al. | 297/347 |
| 4,061,304 | 12/1977 | Schattmaier | 248/404 |
| 4,220,307 | 9/1980 | Hale | 248/404 |
| 4,592,596 | 6/1986 | Slaats et al. | 297/344.19 |
| 4,593,951 | 6/1986 | Slaats et al. | 297/437 |
| 4,756,496 | 7/1988 | Hosan et al. | 297/344.19 X |
| 4,865,382 | 9/1989 | Marshall | 297/195 |
| 4,940,202 | 2/1990 | Hosan et al. | 297/344.19 X |
| 4,969,619 | 11/1990 | Bauer et al. | 248/161 |
| 5,078,351 | 1/1992 | Gualtieri | 248/161 |
| 5,188,345 | 2/1993 | Siegner et al. | 267/131 |

*Primary Examiner*—Richard E. Gluck
*Attorney, Agent, or Firm*—Wood, Herron & Evans

[57] ABSTRACT

A foot stool with improved stability is infinitely adjustable and has an actuating mechanism including a ring actuator which is mounted below a spoked base to be actuated by a person setting on the stool. The ring actuator extends concentrically around the spoked base and around a vertically adjustable column which supports a seat above the floor. The ring actuator is accessible from virtually any position around the stool. Rocking the ring actuator downwardly actuates a lifting mechanism coaxially mounted within the vertically adjustable column, and the weight of the person on the seat may be used to raise and lower the stool height. Since the ring actuator is mounted below the base and close to the floor surface, the person on the stool does not have to substantially lift a leg or shift its weight to actuate the lifting mechanism. Further, the actuating face is generally downward and parallel with the column of the stool so that actuation does not tend to tip the stool seat forward and drive the base rearwardly out from under the sitter. The base of the stool may therefore be lighter and still achieve the same or better stability than stools with heavy bases. Additionally, the stool of the present invention is light weight and comprises a minimum member of parts for inexpensive manufacturing and shipping, and for easy assembly.

5 Claims, 2 Drawing Sheets

GAS OPERATED FOOT STOOL

FIELD OF THE INVENTION

This invention relates generally to stools and, more specifically, to height adjustable stools such as those used by medical and dental personnel.

BACKGROUND OF THE INVENTION

Stools are widely utilized for a number of purposes, but specifically, are utilized by physicians and medical and dental personnel when performing operations and other procedures upon a patient who is lying on a table or seated in a chair. The patients and parts of their bodies may be located at various different heights and positions with respect to the seated physician, and therefore, it is generally necessary to raise and lower the height of the stool seat during the course of the operation so that the physician may perform the operation on the different patient parts and areas without leaving the seated position or unnecessarily stretching or bending. To this end, a number of currently available stools are infinitely height adjustable and generally include a seat mounted on a post which contains a lifting mechanism to allow the level of the seat to be raised and lowered upon actuation of the lifting mechanism. The seat is usually mounted to be rotated by the physician in a complete circle around the post for convenience. With such stools, it is necessary to provide some kind of actuation level for the lift mechanism of the stool located externally of the seat and post to allow the physician to actuate the lifting mechanism and raise and lower the seat level.

Some versions of height adjustable stools provide hand accessible actuation devices including levers and handles which are located proximate the seat and are grasped by the physician's hand and manipulated in a predetermined direction to change the seat height. However, such actuation devices are inconvenient and difficult for the physician to use because they require the physician to stop the operation, put down any medical implements he is using and manipulate the device with his hand. This might not be possible during a particularly critical point of the operation, and the physician may be forced to stand or do the operation at too low of a level.

Therefore, other examples of height adjustable stools utilize foot actuating devices which may be moved with a foot to actuate the lift mechanism and raise and lower the seat level, therefore leaving the hands of the physician free. Some of these stools include pedals or button-like devices which may only be actuated one particular position around the base of the stool. These versions require the physician to pivot the stool seat or stool base around the post in order to press down upon or otherwise actuate the pedal or bottom. While freeing the physician's hands, these stools present other difficulties because the actuation device may be located behind the physician or too far to the side during the critical time of the operation, requiring him to interrupt the operation and turn the stool or to continue the operation standing up or in an abnormal seated position. As a result, constantly rotating the stool around interrupts the medical operation much the same way that hand-actuation of the device does.

Still other stool versions are foot actuated and eliminate the necessity of constantly rotating the seat around the stool to find the actuation device by utilizing a circular pedal or annular flange which extends around the post of the stool and is accessible from any position around the stool. However, the circular actuation devices or pedals utilized by such stools are all mounted at a substantial distance above the floor surface on which the stool sits. Therefore, the point of actuation, that is the point of foot contact where the foot-actuation device intersects with the seat lifting mechanism in order to raise and lower the seat, is also located substantially above the floor surface. With these stools, it is necessary for the doctor to substantialiv lift at least one leg and to shift his weight forward and away from the seat in order to access the device. This leaves the physician precariously balanced on the stool during actuation which is understandably not a desirable position for the physician during a medical operation. Further, lifting of the legs shifts the center of gravity of the physician upward on the chair and forward causing the stool to want to tip over. Still further, part of the force applied to actuate a device positioned relatively high above the floor is directed perpendicular to the post of the stool and has a tendency to push the stool base out from beneath the physician while simultaneously tipping the stool seat forward. This tendency to tip is multiplied by the force moment arm created by the elongated stool post.

Any unnecessary movement by the physician during the surgical operation, such as to locate a single actuation position from around the base of the stool or to lift his leg and shift his weight forward, backward or to either side, restricts, and undesirablv limits, the doctor in accomplishing the task at hand, i.e., operating upon the patient.

A further drawback to current versions of adjustable stools is their complicated design and large number of assembly parts which unduly increases the amount of time necessary to assemble the stool, and increases the difficulty associated with such a task, as well as the cost of the stool. Stools, such as medical stools to be used for the above-described purposes, are often assembled in the field by sales personnel or other distribution personnel, and may also be assembled by the end user of the stool, such as the physicians or other medical persons. Therefore, it is desirable to have a stool with few parts and an uncomplicated assembly so that the stool may be assembled easily, quickly, and with a very small number of necessary tools.

It is an objective of the present invention to present a stool which utilizes a foot actuation device which does not reauire an operator to substantially shift his weight or substantially lift his legs in an attempt to position his foot upon the actuation device. It is a further objective to be able to actuate the lifting mechanism without a force that will tend to push the stool out from beneath the operator or to tip the stool forward. It is still a further objective of the present invention to provide a height-adjustable stool which may be easily actuated from any position around the base of the stool by an operator's foot. It is another objective to provide an inexpensive stool which is light-weight and which uses a small number of separate parts, and which may be easily and quickly assembled in the field with a small number of tools.

SUMMARY OF THE INVENTION

The present invention accomplishes the above-stated objectives and others by providing a stool with a ring actuator located below a spoked stool base which is accessible from any position around the stool. The stool has a seat rotatably affixed to the top end of a vertically telescoping column which fits into the hub of the spoked base which supports the column in a generally vertical position. Mounted beneath the hub of the spoked base is a ring actuator for actuating a lift mechanism to raise and lower the seat height. The ring actuator extends concentrically around the hub and around the column and is accessible to the foot of a person sitting on the seat from any position around the base. The lift mechanism is mounted coaxially within the telescoping column to raise and lower the height of the seat when the ring actuator is rocked downwardly with the foot. The ring actuator, located below the base, is close to the floor surface on which the stool sits; therefore, a person sitting in the seat of the stool may actuate the lift mechanism without substantially shifting their weight in the upward and forward directions or substantially moving their foot away from the floor surface. By rocking the ring downwardly to actuate the lifting mechanism, the foot force applied to the stool is in a direction generally vertical and parallel with the vertical column of the stool so that the actuation does not tend to push the base rearwardty and tip the stool seat forward. This amounts to a more stable stool that is easier to operate without the interruption of an ongoing medical operation or other medical procedure.

The lifting mechanism fitting coaxially within the telescoping column is a gas-operated cylinder including a housing and an extendable rod mounted to move longitudinally within the housing. The rod extends downwardly from the housing and has an actuation valve mounted on its outward end. The gas cylinder is concentrically mounted within the telescoping column so that the outward end of the rod is located proximate the base of the stool when the telescoping column is fitted into the hub of the spoked base.

The column and outward end of the rod fit into an adaptor placed within the hub of the spoked base. A single headed pin fits into the bottom of the adaptor to extend vertically upward into the hub so that one end of the pin is juxtaposed with the actuation valve of the gas cylinder rod. The pin is flat headed at its other side and is inserted through a spring which acts against the head of the pin to bias the pin downwardly away from the valve. The ring actuator contains a ring and a flat bridge portion which extends across the ring from side to side and is generally co-planar with the plane of the ring. The ring actuator is mounted so that the flat bridge portion is juxtaposed with the flat head of the pin and is located at a pre-determined distance from the bottom of the stool base. The ring actuator is rockable with respect to the spoked base, such that rocking the ring actuator downwardly at one side moves the bridge upward against the head of the pin and drives the pin up into the base to contact the valve and actuate the lift mechanism of the seat. In operation, when the ring is rocked and the valve actuated, the weight of the person on the seat of the stool lowers the seat to the chosen height by forcing the rod into the gas cylinder housing. Returning the ring to its rest position locks the rod into position, and therefore, locks the seat at a chosen height. Similarly, to raise the seat, the ring is rocked downwardly and the weight of the person is lifted away from the seat so that the lifting mechanism can drive the seat vertically upward to another height. Again, returning the ring to its rest position locks the seat at the chosen height. Since the ring is located below the base and close to the ground, the raising and lowering may be easily accomplished in one simple step with the operator standing on the ring and pushing his body up and down with his legs. In doing so, both feet remain planted on the ground for stability.

The ring extends concentrically around the base between the spokes of the base so as to be accessible to the foot of a person sitting on the stool from any position around the stool. The area between the relatively thin spokes provides a large access area to the ring actuator. Wheels at the end of the spokes allow the stool to be rolled on a floor. Since the lifting mechanism is actuated essentially below the base, the force applied to the ring for raising and lowering the seat does not create a moment arm on the vertical colunnn tending to tip the stool forward and the base out from underneath the seat. The spoked base may, therefore, be lighter than the prior art bases, making the entire stool lighter, because the extra weight is not needed for stability. The stool is therefore cheaper to transport and easily picked up and moved around an office or operating area.

The stool comprises a minimal number of parts making it relatively inexpensive to manufacture, and it may be easily and quickly assembled in the field using only one tool. These and other advantages will become more apparent in the detailed description of the invention below.

DETAILED DESCRIPTION OF THE DRAWINGS

Figure 1:
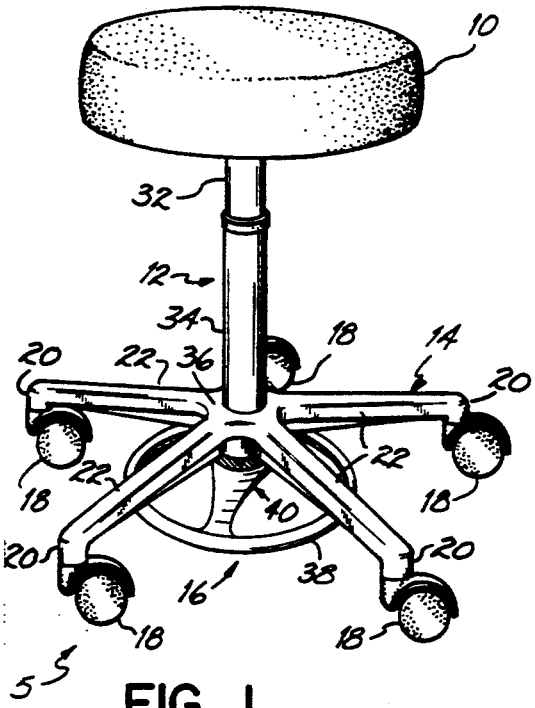
FIG. 1 is a perspective view of the stool of the present invention.

Referring to FIG. 1, the stool 5 of the present invention includes a seat 10, vertically telescoping column 12, a spoked base 14, and a ring actuator 16 mounted below the spoked base 14 and extending concentrically around the stool 5 below the base 14. Wheels 18 are mounted at the radially outward ends 20 of the individual spokes 22 to allow the stool 5 to roll about a floor surface. The seat 10 is comprised of a foam body covered with fabric as is common with commercially available stools. The seat 10 has a rigid bottom 26 (FIG. 2) so that the seat 10 may be mounted to column 12 to extend in a generally horizontal plane above the floor surface to receive the weight of a physician or other sitting person. The word physician is used herein to generally mean the person sitting on the stool. While the stool is particularly useful for physicians, it can serve in any one of numerous other functions.

Figure 2:
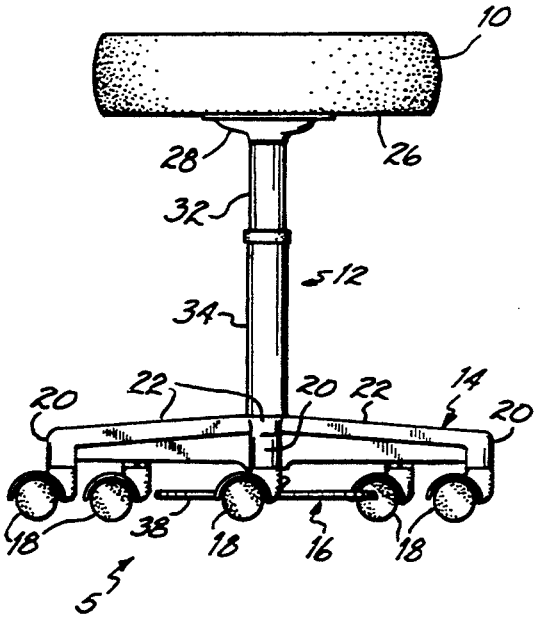
FIG. 2 is a side elevational view of the stool of FIG. 1.
Figure 3:
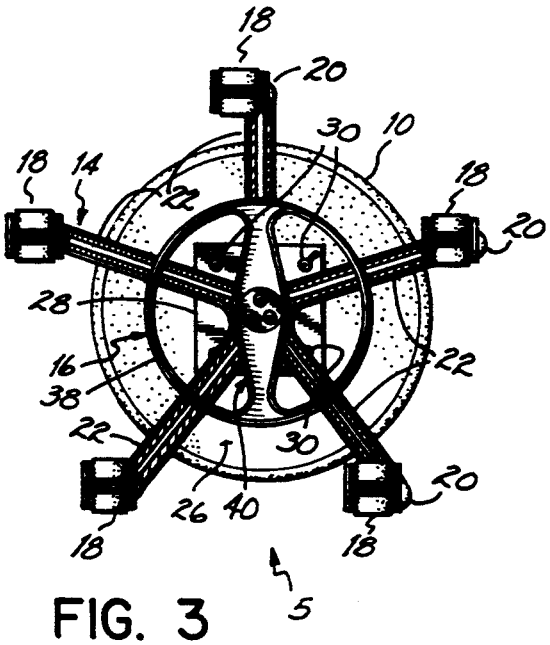
FIG. 3 is a bottom plane view of the stool of FIG. 1.
Figure 5:
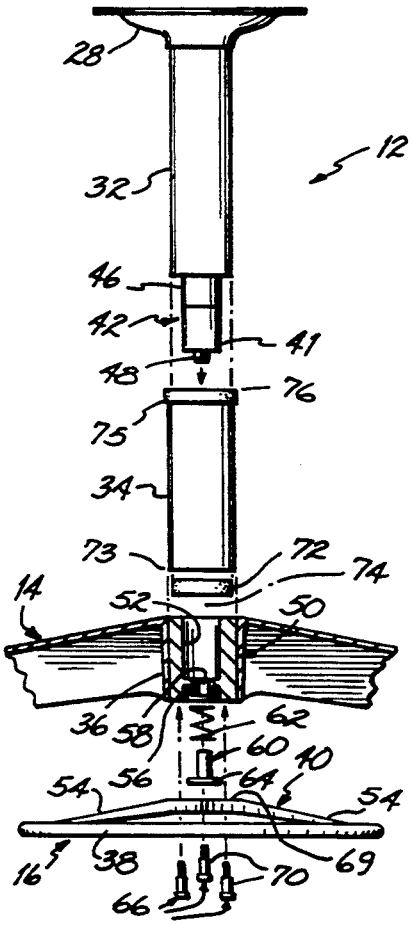
FIG. 5 is an exploded elevational view, partially in cross section, of the adjustable column and base of the stool FIG. 4.

As seen in the side view of FIG. 2, the rigid bottom 26 of seat 10 is attached to a mounting plate 28. Bottom 26 of seat 10 is mounted to plate 28 using screws 30 (FIG. 3) or any other suitable fastening means. The telescoping column 12 is fixed to plate 28 to extend downwardly from seat 10 essentially perpendicular with the plane of seat 10. Telescoping column 12 comprises an upper cylindrical member 32 which fits inside a lower cylindrical member 34. Upper member 32 is coaxially mounted inside lower member 34 to move longitudinally inside lower member 34 to present a telescoping column 12 whereby the seat 10 may be raised or lowered in height in accordance with the present invention. The upper end of upper member 32 is fixed to plate 28 which is mounted to seat 10. Plate 28 and member 32 are preferably metal so that the upper end of member 32 may be welded to plate 28 to extend generally perpendicular to the plane of seat 10 and downward therefrom. Plate 28 is preferably mounted in the center of the seat so that column 12 provides generally equal support around seat 10. A gas cylinder lifting mechanism is mounted coaxially within the column 12, as further described hereinbelow, and the bottom end of column 12 is abutted against the hub 36 of base 14. This positions the telescoping column 12 and seat 10, generally in the center of base 14. Telescoping column 12 is frictionally fitted into an adapter hub 36 as shown in FIG. 5 and further described hereinbelow.

The ring actuator 16, for actuating the lift mechanism of stool 5, includes a ring 38 and flat bridge portion 40 which extends across ring 38 from one side of ring 38 to the other. The bridge portion 40 is generally co-planar with ring 38, however, it is slightly elevated as shown in FIG. 5 to further space the ring 38 below base 14 when the actuator 16 is mounted to base 14. Ring actuator 16 is mounted spaced below base 14 so that it may be rocked when the force of the operator's foot is applied to ring 38. Rocking ring 38 downwardly at one side will rock bridge portion 40 upwardly at the opposite site. The bridge portion 40 pushes a pin 60 up into the bottom hub 36 of base 14 which actuates a valve of the gas cylinder lifting mechanism to raise and lower the seat height as is described in greater detail below. (See FIG. 4.) To raise and lower the height of stool 5, a person sitting on seat 10 rocks ring actuator 16 downwardly with his foot while pushing up from a floor surface to relieve the weight load on seat 10. The lifting mechanism, which is actuated by the rocking of ring actuator 16, telescopes column 12 and raises the effective height of seat 10 to its maximum height or the height desired by the physician. When the physician removes his foot, the pin moves away from the valve and the seat height is locked at a particular height. Similarly, to lower seat 10, ring 38 is rocked again by the foot of the physician, and the downward force of the weight of the physician compresses the lifting cylinder and forces member 32 downward into member 34 to reduce the effective length of telescoping column 12 and lower the height of stool 5.

Ring actuator 16 extends concentrically around spoked base 14 through the open area between each of the individual spokes 22. Rocking ring actuator 16 from any position around spoked base 14 of stool 5 is sufficient to actuate the lifting mechanism inside telescoping column 12 so as to raise and lower the height of seat 10. The area around the base of stool 5 which is obstructed by the relatively thin individual spokes 22 is minimal, and therefore, the foot of a person sitting on seat 10 may truly access and rock the ring actuator 16 from virtually any position around the stool. Since ring actuator 16 is located very close to the floor surface upon which stool 5 is in use, the physician does not have to substantially lift his leg in order to position his foot on ring actuator 16. In fact, when raising the level of the seat 10, the physician may push down on ring actuator 16 to rock the ring and actuate the seat lifting mechanism 42 with the same foot which he uses to raise his weight up and off of seat 10 so that the lifting mechanism can push the seat upwardly. Essentially, he can just stand up with at least one heel pushing on ring actuator 16. Further, since actuating the lifting mechanism does not require lifting a leg or legs, the center of gravity of the physician is not shifted upwardly or forwardly making the stool unstable (See FIG. 2). Rather, the physician's feet remain substantially in contact with the floor surface at all times. Additionally, force upon ring actuator 16 to rock the actuator is directed generally downwardly towards the floor and not against column 12 as with other prior art stools. This further makes the stool 5 of the present invention more stable as it reduces the amount of force directed transverse to the column 12, and therefore, reduces the tendency for the stool seat 10 to tip forward and the base 14 to shoot out from below the physician when the seat is actuated.

Figure 4:
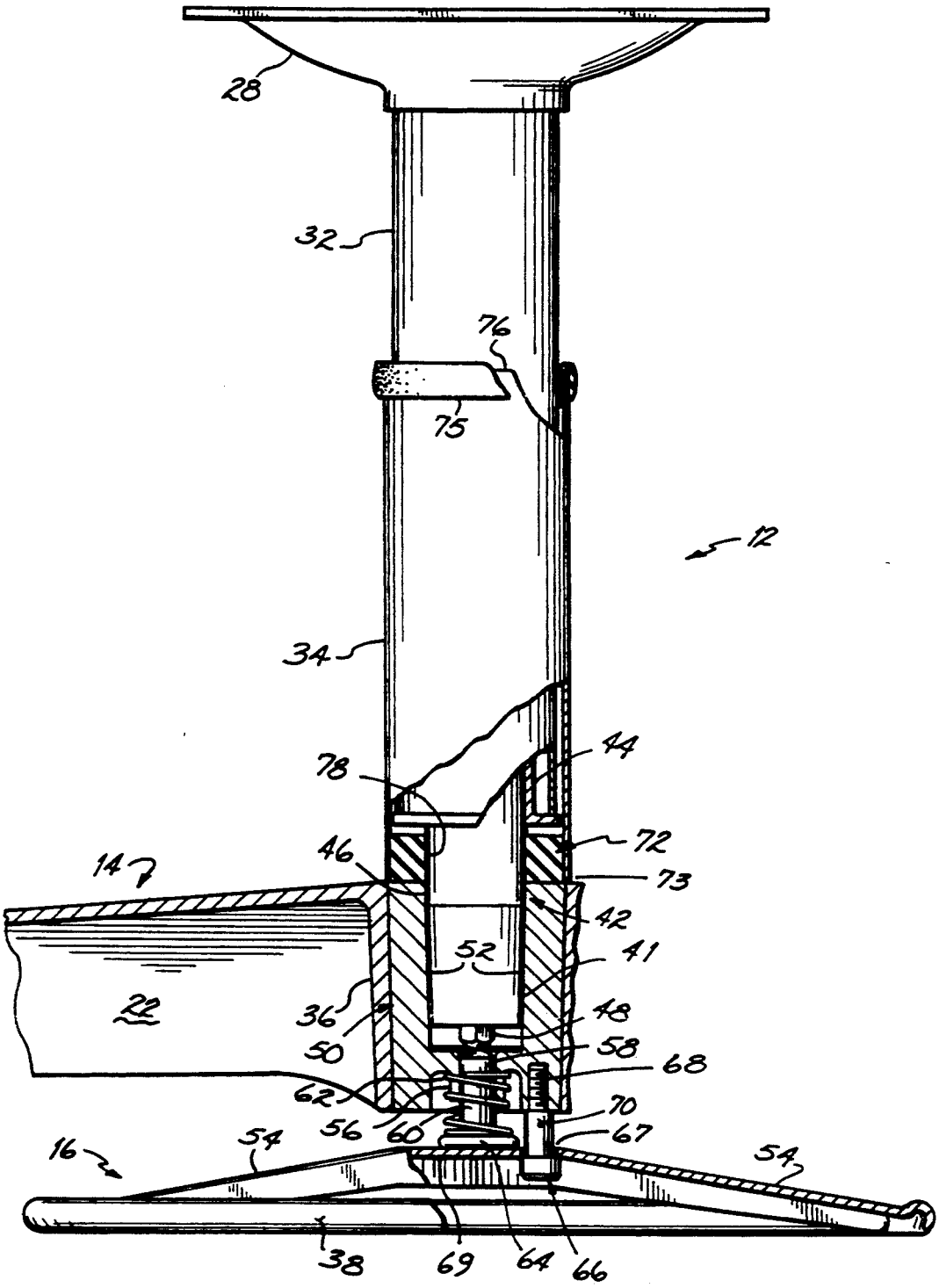
FIG. 4 is an enlarged partial cross-sectional view of the adjustable column and base of the stool of the present invention.

Referring now to FIG. 4, the lifting mechanism or gas cylinder 42 utilized by stool 5 of the present invention is a gas cylinder having a cylindrical housing 44 and an extensible rod 46 mounted coaxially inside of the cylinder 44 to move longitudinally in and out of cylinder 44 when the gas cylinder 42 is actuated. The gas cylinder 42 is a commercially available cylinder, such as the Suspa Model 17-4 cylinder manufactured by Suspa Compart AKTIENGESELLSCHAFT of Germany. Various other gas cylinders, similar to the Model 17-4 by Suspa, are covered by United States patents, such as U.S. Pat. Nos. 3,711,054; 4,969,619; and 5,188,345 which are incorporated herein by reference to offer further illustration of the internal mechanism and operation of the gas cylinder.

As seen in FIG. 4, a gas cylinder 42 such as the Suspa Model 17-4 contains an actuation valve or button 48 located at the outward end of rod 46. When valve 48 is depressed inwardly into the end of rod 46, the gas cylinder 42 extends to its full length absent any external forces to compress rod 46 into the cylinder housing 44. Releasing the valve 48, by way of the ring actuator 16, locks the gas cylinder 42 into the desirable length. Rod 46 may also be compressed when valve 48 is depressed and actuated. Compressing the rod 46 into housing 44 while actuating valve 48 and then releasing valve 48 will lock the rod 46 into its compressed length. Because of the functioning of the cylinder 42, the compressed rod 46 will be biased pneumatically to extend outwardly from housing 44. Therefore, when the valve 48 is depressed and the compressing forces are released from cylinder 42, the rod 46 again extends outwardly to its full length. The gas cylinder 42 is mounted coaxially within the telescoping column 12 such that the rod 46 extends longitudinally inside the column 12 in a downward direction.

Referring again to FIG. 4, an adaptor 50 is mounted coaxially inside the hub 36 of the spoked base 14. Adaptor 50 has a top cylindrical opening 52 formed in the center thereof to receive the cylindrical outward end 41 of the gas cylinder rod 46. Adapter opening 52 is tapered in diameter from top to bottom along its length such that the outward cylindrical end 41 of rod 46 frictionally fits within adapter 50. The adapter 50 is positioned within the hub 36 of spoked base 14 such that when rod 46 is inserted into center opening 52, the telescoping column 12 of the stool is supported vertically upright generally perpendicular to the floor surface on which the stool base 14 sits. The bottom of the adapter 50 has a cylindrical boss 56 formed therein with a center opening 58 dimensioned to receive an actuating pin 60 which extends up through the bottom of adapter 50 such that the top end of pin 60 is juxtaposed with valve 48 when the stool 5 is assembled. Pin 60 is dimensioned to be freely slidable in opening 58 so as to move upwardly in boss 56 against valve 48 and depress the valve thereby actuating the gas cylinder 42 when ring actuator 16 is rocked. A spring 62 is positioned around the boss 56 and around pin 60, and the lower end of pin 60 includes a flat head 64 which abuts against the bottom end of spring 62. Spring 62, pressing against adapter 50 and the flat pin head 64 of the actuating pin 60 biases the pin 60 downwardly away from valve 48.

The flat bridge 40 of the ring actuating mechanism 16 is secured to the bottom of adapter 50 by threaded shoulder screws 66 which extend through openings 67 in the bridge 40 and into threaded holes 68 formed in the bottom of the adapter 50 peripherally around center boss 56. Shoulder screws 66 have a shoulder 70 which determines the maximum distance which bridge 40, and therefore ring 38, are positioned from the bottom of spoked base 14. A round center portion 69 of the bridge 40 connects two inclined sections 54 which extend from the center portion 69 to connect with ring 38. The center portion 69 is mounted in coaxial alignment with the round end of adaptor 50 to lie generally parallel with the plane of the floor and perpendicular column 12. This disposes the ring actuator 16 in a plane generally perpendicular with column 12. When the ring actuator is mounted to base 14, the center portion 69 is juxtaposed with the flat head 64 of actuating pin 60. Spring 62 biases pin 60 downwardly against center portion 69 so that the ring 38 is maintained in a special relation to the bottom of base 14 and adapter 50 so as to be rockable thereunder. The shoulder screws 66 act as a fulcrum for the ring actuator 16. Preferably, at least three shoulder screws 66 are positioned equidistant from the column center around the bottom of adapter 50 to steady the ring actuator 16 and maintain the ring actuator 16 in a plane substantially parallel with the plane of the floor surface. Two screws might be sufficient for operation; however, three are preferable to maintain the ring actuator 16 generally parallel to the floor.

When ring actuator 16 is rocked downwardly at one side, the center portion 69 of the bridge 4D, which is juxtaposed with the flat head 64 of actuating pin 60, is levered upwardly at the opposite side against the force of spring 62 and into adapter opening 58 to depress valve 48 and actuate the gas cylinder 42. The physician sits on seat 10 while the ring actuator 16 is rocked, and the valve 48 is depressed into the end of rod 46 of cylinder housing 44 from the force of his weight. The physician then moves his body up and down to set the height of stool 5. When the ring actuator 16 is released, pin 60 is biased away from valve 48 by spring 62, and the cylinder 42 is deactivated to lock the stool 5 at the desired height. To raise the seat height, the procedure is repeated, except the physician moves his weight upwardly away from seat 10, and the gas cylinder 42 moves the seat upwardly to its full height or the desired height. Releasing ring actuator 16 again locks the stool 5 at the chosen height. In this way, the stool 5 of the present invention may be raised and lowered in height using ring actuator 16 which is mounted below spoked base 14. Since the actuation mechanism of stool 5, including ring actuator 16, valve 48 and actuation pin 60, is located substantially below the stool at the bottom of base 14, the physician may keep his feet on the floor when raising and lowering the seat 10. This makes stool 5 more stable because the physician's weight is not shifted forward or to one side. The physician may simply stand on the floor with at least one heel on the ring 38 and move up and down to adjust height. Furthermore, the downward force to rock ring actuator 16 and the upward force against pin 60 are parallel with column 12. Since there is no actuation force applied by the sitting physician which is substantially perpendicular to telescoping column 12, there is substantially no moment arm created by column 12 on the stool seat 10 which would tend to tip the stool seat 10 forward and/or propel the stool base 14 out from under the physician and rearward of the physician. This further increases the stability of stool 5 of the present invention. Therefore, positioning the ring actuator 16 below the spoked base 14 and maintaining the actuation elements of the seat lifting mechanism generally below the base 14, presents a more stable stool 5 which may be actuated by the feet of a physician from any position around the stool in accordance with one objective of the present invention.

In accordance with another objective of the present invention, stool 5 is assembled using a minimal number of parts and essentially only one tool. FIG. 5 is a disassembled elevational view of stool 5 showing the mounting plate 28, the telescoping column 12, the spoked base 14, and the ring actuator 16. During shipment of stool 5, the gas cylinder 42 would preferably come mounted within the inner cylindrical member 32 such that only a section of rod 46 extends downwardly past the bottom end of member 32. Plate 28 preferably is pre-secured to the top end of cylindrical member 32 such as through welding. Seat 10 also is preferably mounted to plate 28 such as by using screws 30 or other suitable fasteners. To begin assembly, a rubber washer 72 is fitted into the bottom end 73 of outer cylindrical member 34 to lie flush with the bottom edge of cylindrical member 34. A rubber cap 75 may be inserted over the upper end 76 of the outer cylindrical member 34 in order to prevent the metal upper end 76 from rubbing against the metal sides of the upper cylindrical member 32 when the two members are telescopically seated together to form telescoping column 12. Next, the inner member 32 and gas cylinder are inserted into outer cylindrical member 34. The outward end 41 of rod 46 is inserted through a cylindrical opening 78 in the center of the washer 72. The cylindrical opening in the center of washer 72 is slightly smaller than the outer diameter of the outward end 41 of rod 46 so that there is a friction fit between washer 72 and the end of rod 46. In this way, upper member 32 and lower member 34 are secured together. Inner member 32 and the gas cylinder 42 are inserted into outer member 44 such that preferably the outward end 41 of rod 46 extends approximately two inches beyond the bottom end 73 of member 34 and washer 72. This completes the first half of the assembly.

Next, the adapter 50 is placed in the hub 36 of the spoked base 14. The opening in hub 36 is slightly tapered from the top of the base 14 to the bottom of the base so that the cylindrical adapter 50 generally has to be pounded into hub 36 so that the top edge of the adapter 50 is flush with the top edge of hub 36. The base 14 containing the adapter 50 is then inverted and the spring 62 is placed over cylindrical boss 56 of adaptor 50 (see FIG. 4). The headed pin 60 is inserted through the spring 62 and into the center opening 58 of boss 56. At this point the flat head 64 of the pin 60 rests against one side of spring 62. The ring actuator 16 is then placed on top of the head 64 of pin 60 so that the flat outer portion of bridge 40 is juxtaposed with the flat head 64, and the ring 38 is centered around longitudinal axis 74 of the telescoping column 12. The openings 67 in bridge 40 are aligned with the threaded holes 68 of adaptor 50. The shoulder screws 66 are then inserted through openings 67 and into the threaded holes 68 and screwed in to secure ring actuator 16 to the bottom of base 14. The shoulder 70 on each screw 66 determines the depth of penetration of the screw 66 into the tapped holes 68 and also the spacing of ring actuator 16 from base 14. Since spring 62 biases the headed pin 60 downwardly against bridge 40, the ring actuator 16 is biased away from the bottom of base 14. The distance between bridge 40 and the bottom of base 14 is determined by the length of the shoulder 70 on screws 66.

When the ring actuator 16 has been secured to the bottom of base 14, the base is placed upright and placed on the floor. The column assembly 12 can now be mounted into the base assembly. The outward end 41 of rod 46 is positioned inside the center cylindrical opening 52 of adapter 50. The cylindrical end of rod 46 is forced into the tapered adapter opening 52 of adapter 50 to securely support the seat 10 above the floor surface and generally horizontal. When assembling stool 5, the only tool that is normally needed is the tool necessary to secure the shoulder screws into the bottom of base 14, such as a flathead screwdriver, phillips head screwdriver, or allen wrench, depending upon the heads of the shoulder screws 66. Finally, the outer cylindrical member 34 is slid down over the inner cylindrical member 32 so that the bottom of member 34 contacts the top of base 14. Stool 5 of the present invention is, therefore, easy to assemble with a minimal number of tools and assembly parts to manipulate. Consequently, the stool 5 can be assembled very quickly and efficiently in the field by a person having very little or no mechanical knowledge.

While these and other features of the gas operated foot stool of the present invention have been described in accordance with a preferred embodiment of the invention, it is to be understood that the invention is not limited thereby. In light of the present disclosure, various other alternative embodiments will be apparent to one of ordinary skill in the art without departing from the scope of the patent. For example, while the ring actuator of the aperture plate utilizes a ring circling the bridge portion, the ring actuator also might be a solid circular plate which may be rocked to raise and lower the stool. Further, other actuating mechanisms, besides a spring-biased pin, might be utilized to actuate the valve of the gas cylinder and adjust the stool height. Accordingly, applicant does not intend to be bound only by the preferred embodiment of the gas-operated foot stool disclosed in the detailed specification.

I claim:

1. A vertically adjustable stool comprising:

a seat to receive the weight of a sitting person;

a vertically telescoping column to support the seat having an upper and lower end and a longitudinal axis, the column being attached to the seat at its upper end;

a spoked base having a hub opening to receive the bottom end of the column and support the column generally vertically upright, the spokes projecting radially outward from the hub to support the hub above a floor surface;

a seat lifting mechanism mounted within the telescoping column to telescope the column and raise the seat height when actuated, the mechanism including actuation means for actuating the lifting mechanism located proximate the bottom end of the column and proximate the base;

a ring actuator rockably attached below the base, and suspended above the floor surface in a plane generally parallel to the floor surface, the ring actuator extending concentrically around the hub below the base so as to be accessible between the spokes to a foot of the sitting person from any position around the base, the ring actuator rockable about said plane and in operable communication with the actuation means when rocked to raise the height of the seat;

whereby a person sitting in the seat is able to rock the ring actuator with his foot and thereby effect raising and lowering of the seat.

2. The stool of claim 1, the seat lifting mechanism comprising a gas cylinder including a cylindrical housing and an extendable rod with an outward end longitudinally movable within the cylindrical housing to extend from said housing, the actuator means being a valve located at the outward end of said rod which is onetable, when depressed, to extend the rod to its full length, the gas cylinder coaxially positioned within the telescoping column with the valve located proximate the base, the ring actuator operably communicating with the valve to depress the valve for raising and lowering the seat when rocked.

3. The stool of claim 1 wherein the ring actuator comprises a ring and a flat bridge portion extending across the ring generally perpendicular to the column, the bridge portion rockably mounted below the base to suspend the ring above the floor, the stool further including a pin mounted to extend vertically upward into the hub and contact the actuation means at one end of the pin, the bridge portion juxtaposed with the other end of said pin such that rocking the ring at one side raises the bridge portion at the opposite side and drives the pin vertically upward to contact the actuation means and raise and lower the seat.

4. The stool of claim 1 wherein each spoke has rolling means attached at its radially outward end to collectively support the spoked base above a floor surface and allow the base to roll on the floor surface.

5. A vertically adjustable stool comprising:

a seat to receive the weight of a sitting person;

a vertically telescoping column with opposing ends including an outer cylinder with a lower end and an inner cylinder, the cylinders slidably mounted one inside the other to form said column, an upper end of said column mounted to said seat to support the seat;

a seat lift mechanism mounted coaxially in the column to raise the seat, the mechanism comprising a gas cylinder with a cylindrical housing and an extensible rod longitudinally movable within the cylindrical housing to extend downwardly from said housing within said column, the rod having an outward end with a valve located at the outward end which operates the gas cylinder to extend the rod to its full length when the valve is actuated, the outward end of the rod located proximate a spoked base;

the spoked base having a hub and spokes projecting radially outward therefrom, the hub adapted to receive the outward end of the rod and support the telescoping column in a generally vertical position with the valve positioned proximate the base, each spoke including wheels mounted on its radially outward end to collectively support the spoked base above a floor surface and allow the base to roll on the floor surface;

a pin movably mounted to extend upwardly from below the base into an opening in the hub, one end of the pin juxtaposed with the valve, the pin being spring biased downwardly away from the valve;

a ring actuator for actuating the valve and operating the gas cylinder, the actuator comprising of a ring and a flat bridge portion extending across the ring, the bridge portion rockably mounted to the hub below the base to suspend the ring spaced from and below the base in a plane generally parallel the floor surface, the bridge portion juxtaposed with the other end of said pin such that rocking the ring at one side raises the bridge portion at the opposite side and drives the pin against the valve to actuate the gas cylinder and raise and lower the seat, the ring extending concentrically around the hub below the base so as to be rockable between the spokes of the base from any position around the base.

* * * * *